US008888551B2

(12) United States Patent
Xu

(10) Patent No.: US 8,888,551 B2
(45) Date of Patent: Nov. 18, 2014

(54) AEROBAT TOY

(76) Inventor: Yuehuang Xu, Guangdong (CN)

( * ) Notice: Subject to any disclaimer, the term of this patent is extended or adjusted under 35 U.S.C. 154(b) by 236 days.

(21) Appl. No.: 13/512,345

(22) PCT Filed: Apr. 23, 2010

(86) PCT No.: PCT/CN2010/000563
§ 371 (c)(1),
(2), (4) Date: May 28, 2012

(87) PCT Pub. No.: WO2011/066708
PCT Pub. Date: Jun. 9, 2011

(65) Prior Publication Data

US 2012/0231696 A1 Sep. 13, 2012

(30) Foreign Application Priority Data

Dec. 4, 2009 (CN) ..... 2009 1 0194368

(51) Int. Cl.
*A63H 27/127* (2006.01)
*A63H 27/00* (2006.01)

(52) U.S. Cl.
CPC ..... *A63H 27/12* (2013.01)
USPC ..... 446/37; 446/34; 446/57; 446/58; 244/23 A; 244/17.23; 244/7 B

(58) Field of Classification Search
USPC ..... 446/34, 36, 37, 57, 58; 244/7 B, 17.23, 244/23 A
See application file for complete search history.

(56) References Cited

U.S. PATENT DOCUMENTS

| | | | | |
|---|---|---|---|---|
| 6,854,686 | B2 * | 2/2005 | Perlo et al. | 244/7 B |
| 7,789,341 | B2 * | 9/2010 | Arlton et al. | 244/7 A |
| 2004/0129827 | A1 * | 7/2004 | Perlo et al. | 244/7 B |
| 2004/0200924 | A1 * | 10/2004 | Clark et al. | 244/7 B |

* cited by examiner

*Primary Examiner* — Gene Kim
*Assistant Examiner* — Urszula M Cegielnik

(57) ABSTRACT

An aerobat toy comprising propellers (30), a fuselage (50) and an undercarriage (70), wherein the propellers (30) comprise a first propeller (310) and a second propeller (320); the first propeller (310) is provided at a top part of the fuselage (50), and the second propeller (320) is provided between the fuselage (50) and the undercarriage (70) thereunder.

2 Claims, 4 Drawing Sheets

AEROBAT TOY

BACKGROUND OF THE INVENTION

The present invention relates to a toy, and specifically relates to a large sized aerobat toy.

Recently, there are increasing number of various new designs for aerobat toy from airplane to flying saucer and even various kinds of birds and insects. A common aerobat toy comprises a toy body and a remote control; the toy body comprises a propeller unit, a fuselage and an undercarriage; the propeller unit takes a single propeller form or a twin propeller form for elevation of the aerobat toy; the single propeller form has a pair of propellers on an upper part of the fuselage; the twin propeller form has two pairs of propellers on an upper part of the fuselage; the propellers are driven by a single motor; the fuselage comprises a head cover, a trunk and a tail; the trunk and the tail are adjacent to the head cover; the tail is fixedly connected to a rear part of the trunk of the fuselage; the tail is provided with tail fins to assist balance control of the aerobat during its flight for maintaining balance of the aerobat and assisting in changing direction. Some aerobats could change direction by using the propellers or a rudder device on its upper part, and then being assisted in balance control by the tail fins, but this kind of structure is only suitable for smaller sized aerobat because using this kind of structure on large sized aerobat would result in poor elevation ability and poor stability due to greater resistance of large sized aerobat. Furthermore, frequent direction changing operations by the single motor when changing control status increases mechanical frictions and power consumption, resulting in increased energy consumption which shortens battery's life, higher demand for electrical machinery, higher costs, susceptibility to heating and mechanical failure, and shortened service time and life of battery and electrical machinery. Moreover, due to frequent direction changing operations by the single motor when changing control status, control operation process of the aerobat is obstructed, flight of the aerobat is unstable, and remote control operation is not smooth. Besides, the single motor could not enable left and right turning of the fuselage or maintain a stationary hover. In addition, no aerobat has been designed to resemble a large sized cylinder, such as in various bottle shapes or shapes in other drinking cans etc., which is more spectacular and could serve as business promotional means.

BRIEF SUMMARY OF THE INVENTION

In view of the aforesaid disadvantages now present in the prior art, the present invention provides a propeller system with a special design consisting of propellers disposed respectively at an upper and a lower part of a casing, a more spectacular aerobat which could be controlled to change flying directions or maintain a stationary hover due to driving by two independent transmission systems, and a large sized aerobat toy which makes a breakthrough in existing shapes of fuselage and adopt a cylindrical shape or other special shapes.

Improvements are made by the present invention in view of the aforesaid disadvantages now present in the prior art. The present invention provides an aerobat toy comprising propellers, a fuselage and an undercarriage, wherein the propellers comprise a first propeller and a second propeller; the first propeller is provided at a top part of the fuselage, and the second propeller is provided between the fuselage and the undercarriage thereunder; each of the first propeller and the second propeller is not limited to have only one pair of blades thereon but there may be two or three blades arranged in layers or several blades arranged together in one same layer. The spirit of the present invention is that propellers are provided at an upper part and a lower part of the fuselage respectively.

The two propellers have their transmission axes on one and identical vertical line. The transmission axes of the two propellers have a separated top and bottom structure on the one and the same vertical line. Transmission mechanisms driving the transmission axes are mutually independent and mounted in reversed directions, and they comprise two motors wherein the first propeller is driven by a first motor of the two motors and the second propeller is driven by a second motor of the two motors, and the propellers rotate in mutually reversed directions. However, the transmission mechanisms are not limited to two motors but may be driven by a single motor or multiple motors, for example, the second propeller is driven by a single motor, wherein the second propeller is a dynamic propeller for elevation of the aerobat, and the first propeller is passively rotated in a reversed direction by influence of air current, alternatively, the first and second propellers are driven by the single motor simultaneously, wherein the first and the second propellers rotate in mutually opposite directions.

The fuselage adopts a cylindrical shape, a bottle shape, a cubic shape, a prismatic shape, a regular or an irregular shape.

The first propeller comprises a connection block, blades and balance rods; wherein the connection block, the blades and the balance rods are connected by hinges; the second propeller comprises a connection block and blades and the blades are mounted at ends of the connection block respectively.

The balance rods comprise balance main rods and balance blocks; and the balance blocks are provided at ends of the balance main rods respectively.

The balance rods and the connection block of the first propeller are connected by hinges.

The first propeller is a single-piece propeller or it has blades arranged in a cross shape; the second propeller is also a single-piece propeller or it has blades arranged in a cross shape.

The present invention discloses bold changes of aerobat's structure by introducing a structure unknown in the past: propellers are mounted at an upper and a lower part of an aerobat respectively. According to experiments, an aerobat designed according to the present invention is more stable and more satisfactory in flying performance and controllability. In particular, for larger sized aerobat subject to greater air resistance, a design of upper and lower propellers reduces drag volume and enhances elevation ability, and is therefore more suitable for large sized aerobat.

Repeated experiments reveal that double layer propellers using a common axis have poor elevation ability because of large sized aerobat body and greater resistance, and they also create a certain degree of frictions and show relatively poorer performance, and their stability is also affected. Therefore, the present invention modifies the above structure of the propellers to solve the problems of high resistance, poor performance and instability by not using a common axis mechanism but instead using two independent transmission axes separated from each other in the middle with one and the same straight axle line.

The aerobat toy has the following advantages compared to the prior art:

1. By using a design of upper and lower propellers, drag area is reduced by half; elevation ability of the aerobat is therefore effectively enhanced and flying of the aerobat is more stable;

2. By using two transmission axes with the same axle line, frictions and energy waste on a common axis generated by a motor during changes in direction could be reduced, and operation stability could be effectively enhanced;

3. By using a fuselage in shapes such as an easy-open can shape and a bottle shape, breakthrough is made in the appearance of an aerobat; shapes without an aerobat tail are new forms suitable for even wider range of usages and results in more beautiful, diversified and spectacular aerobat designs;

4. Since the connecting parts of the propellers mostly adopt hinge connections, meaning that the propellers are adjustable propellers, so that they are not susceptible to deformation when impacted, and they also effectively prevents hurting an operator and significantly improve playing safety;

5. Use of double motors to control an upper propeller and a lower propeller respectively prevents increased frictions and high energy consumption due to rotation of aerobat's body under control using a single motor; also, the aerobat could be completely under control, for example, it may be controlled to turn left or right or maintain a stationary hover; and control is exercised in a smoother and brisker way.

As a result of the above, aerobats have diversified appearances in the air adaptable to different commercial uses such as advertisements. Functional diversification of product is therefore achieved, and new forms of expression and new channels of application are established in this technical field. A major breakthrough in large sized aerobat objects emerges as there is a new invention in the field of structural design application. For example, fuselage of an aerobat could be designed as one resembling a cola can or other cans with a special design for promotion purposes and as a gift.

DETAILED DESCRIPTION OF THE INVENTION

Figure 1:
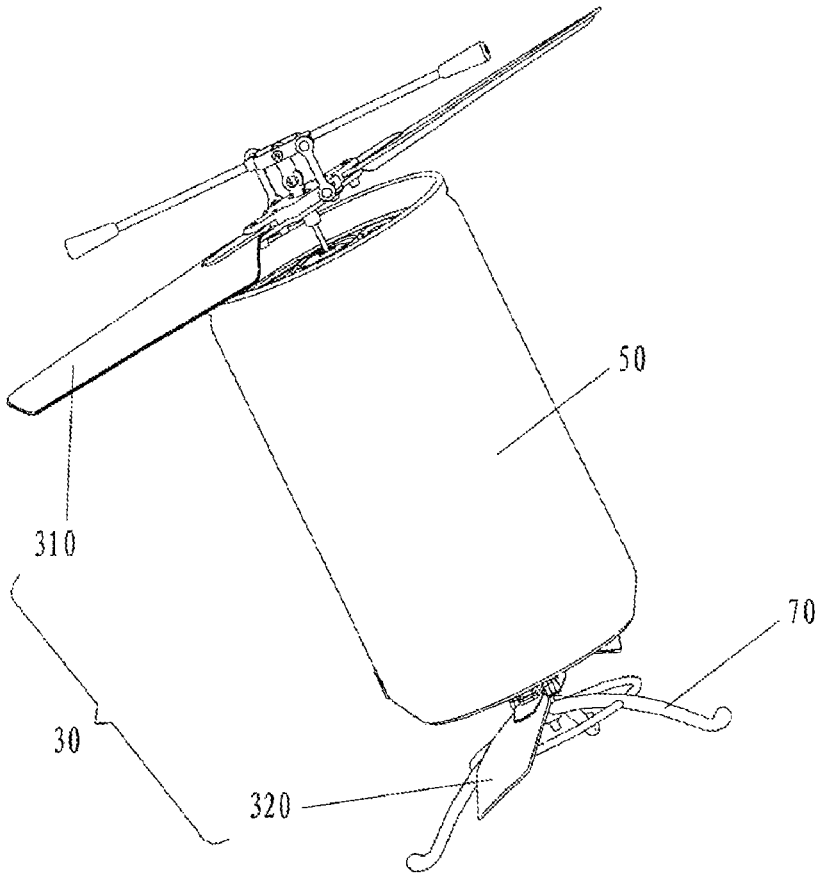
FIG. 1 is a perspective structural view of the aerobat toy according to the present invention.
Figure 2:
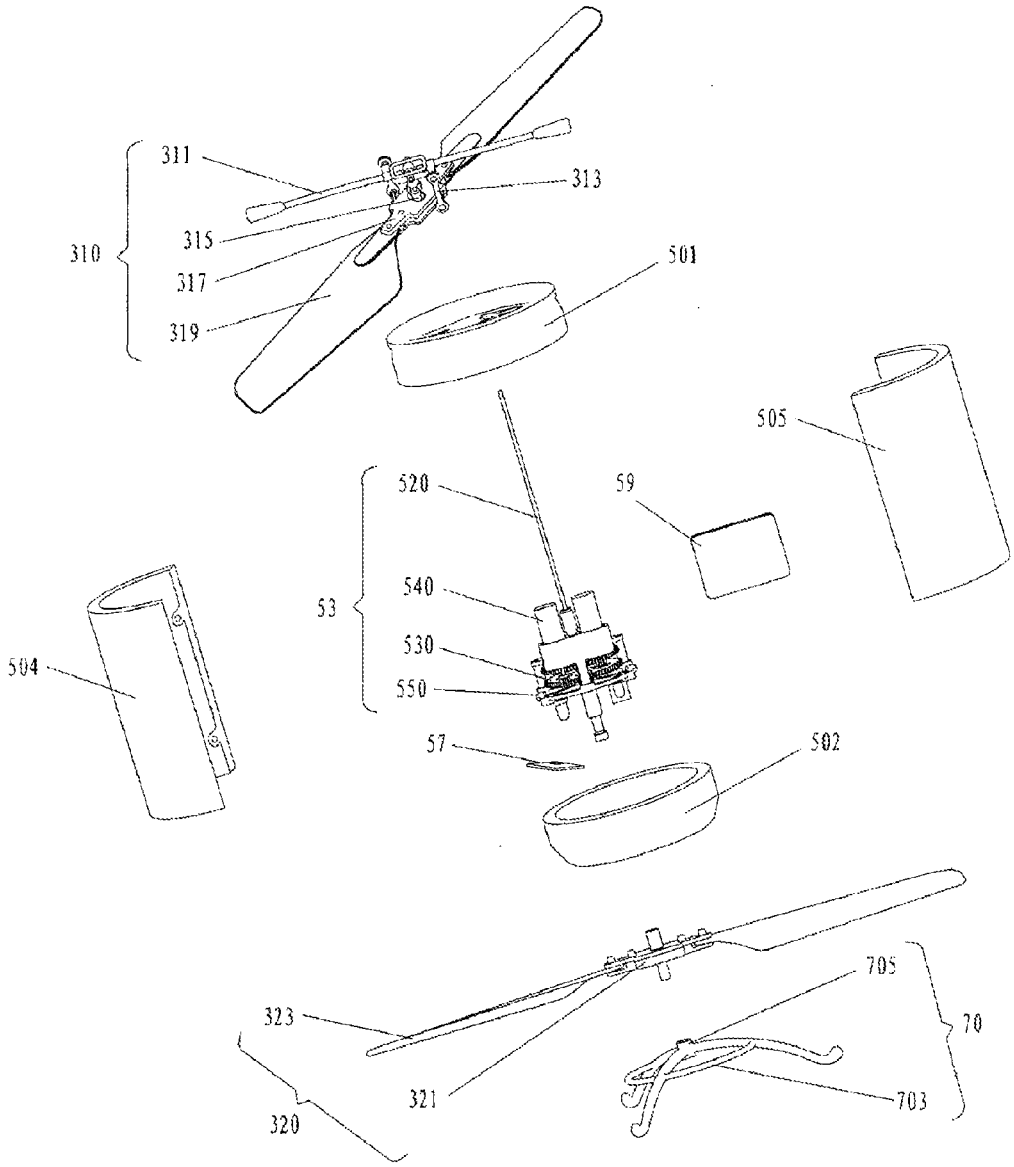
FIG. 2 is a perspective exploded view of the aerobat toy according to the present invention.

Reference is made to FIG. 1 and FIG. 2, wherein an aerobat of an aerobat toy comprises propellers 30, a fuselage 50 and an undercarriage 70, wherein the propellers 30 comprises a first propeller 310 and a second propeller 320; the first propeller 310 is provided at a top part of the fuselage 50, and the second propeller 320 is provided between the fuselage and the undercarriage thereunder.

The two propellers have transmission axes 520 on one and the same vertical line. In the present embodiment of the two propellers, their transmission axes 520 have a separated top and bottom structure on the one and the same vertical line; the transmission axes of the two propellers is driven by independent driving mechanisms; and the transmission axes 520 have mutually reversed rotating directions.

When the first propeller 310 rotates in a clockwise direction, the second propeller 320 rotates in an anti-clockwise direction, and vise versa; the fuselage 50 comprises fuselage walls, a transmission system 53, a controller 57 and a power supply 59, wherein the transmission system 53 comprises the transmission axes 520, transmission gears 530, a power source 540 and a mechanical frame 550; the transmission axes 520, the transmission gears 530 and the power source 540 are assembled and fixed in position via the mechanical frame 550; the transmission axes 520 are connected to the transmission gears 530; the transmission gears 530 are connected to the power source 540; the power source 540 is connected to the controller 57; the controller 57 is connected to the power supply 59; the transmission system 53, the controller 57 and the power supply 59 are respectively installed in a cavity formed by the fuselage walls; the undercarriage 70 is mounted at a bottom part of the fuselage 50.

When using the aerobat toy, operation signals are generated by a remote control whereas the controller 57 inside the fuselage 50 will then receive the operation signals and after that generate control signals to control the transmission system 53; flying of the aerobat toy under remote control is therefore achieved. Structure of and connecting relationships between each part of the aerobat toy are described in detail below. The remote control and signal receiver of the present invention could be those remote controls and receivers currently available in the market.

Figure 3:
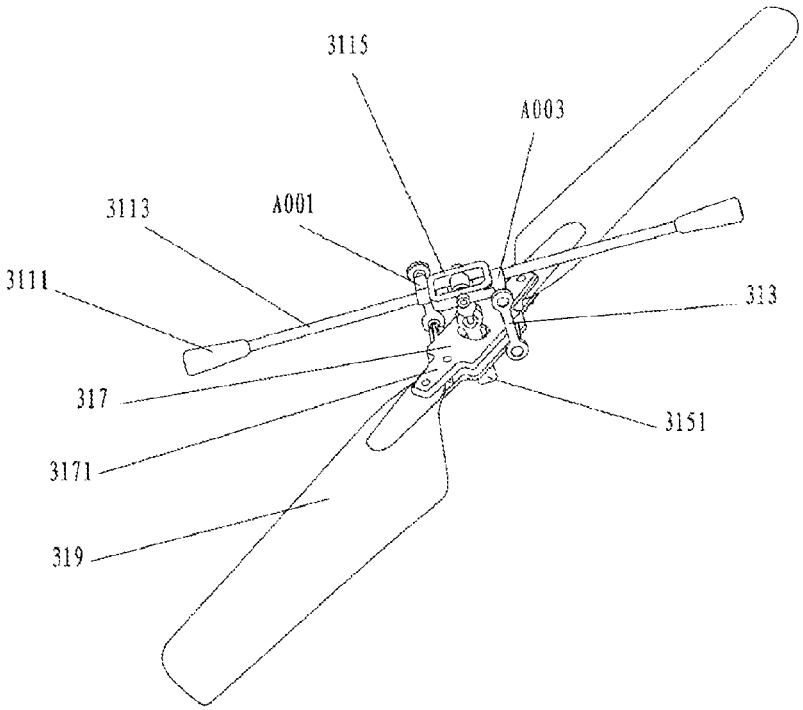
FIG. 3 is a perspective structural view of a first propeller of the aerobat toy according to the present invention.
Figure 4:
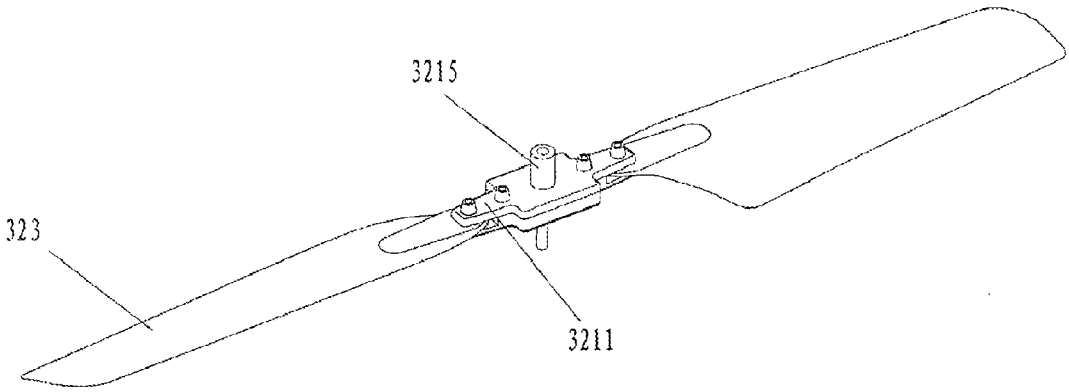
FIG. 4 is a perspective structural view of a second propeller of the aerobat toy according to the present invention.
Figure 5:
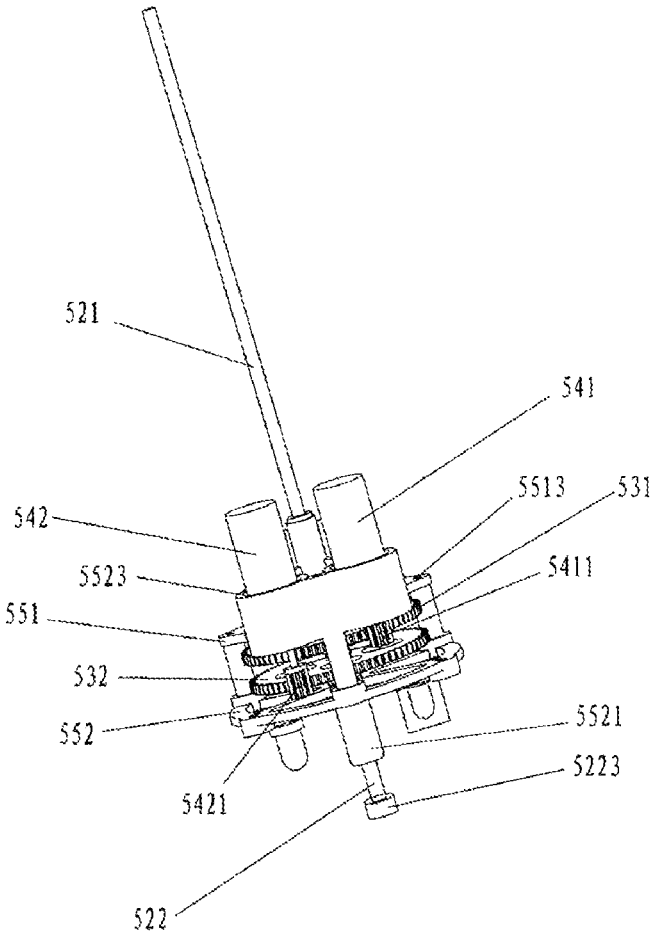
FIG. 5 is a perspective structural view of a rotation system of a fuselage of the aerobat toy according to the present invention.

Reference is made to FIG. 2 to FIG. 4, wherein the propellers 30 comprise the first propeller 310 and the second propeller 320; the first propeller 310 is a single-piece propeller and comprises balance rods 311, connection rods 313, a first main axis 315, a connection block 317 and blades 319, wherein the balance rods 311 are configured with a parallel structure comprised of three parts, namely balance blocks 3111, balance main rods 3113 and a connector 3115; the balance blocks 3111 are connected to the balance main rods 3113; the balance main rods 3113 are connected to the connector 3115; the balance blocks 3111 are square clump weights; the balance main rods 3113 have circular cross section; the connector 3115 is a square frame configured to be structurally parallel. Hinge configurations are provided respectively at two diagonal points A001 and A003 of the square frame of the connector 3115 and a middle point of a diagonal line thereof; the connector 3115 is hinged with two balance rods 311 at its said diagonal points A001 and A003; the said middle point of the diagonal line of the connector 3115 is hinged with an end of the first main axis 315; another end of the first main axis 315 is provided with a fixing base 3151; the first main axis 315 is fixedly connected to the transmission axes 520 via the fixing base 3151 thereon; the connection block 317 is a board configured to be structurally parallel and provided with a center opening; a center part of the connection block 317 is in square shape; an extension arm 3171 is extended from each of two opposing sides of the square shaped center part of the connection block 317; the two extension arms 3171 are hinged respectively with the two blades 319 of the first propeller 310; another two opposing sides of the connection block 317 are provided respectively with axle pins 3173 for hinge connection of the connection block 317 with another end of the two connection rods 313 so that the balance rods 311 and the two blades 319 are angularly offset from each other. Quantity of blades 319 is two, and each blade 319 has its front edge slightly configured upward and its rear edge configured downward.

The second propeller 320 is a single-piece propeller and comprises a connection block 321 and blades 323; the connection block 321 is a board configured to be structurally parallel and provided with a center opening; a center part of the connection block 321 is in square shape; an extension arm 3211 is extended from each of two opposing sides of the square shaped center part of the connection block 321; the two extension arms 3211 are hinged respectively with the two blades 323 of the second propeller 320; a fixing base 3215 is provided on the connection block 321; the connection block 321 is fixedly connected to the transmission axes 520 via the fixing base 3215. Quantity of blades 323 is two, and each blade 323 has its front edge slightly configured upward and its rear edge configured downward. By using a design consisting of upper and lower propellers, the second propeller 320 has nearly no drag surface, therefore, drag area of the two propellers is reduced by half and thereby effectively enhancing elevation ability of the aerobat toy. Also, due to cooperative operation of the second propeller 320 with the first propeller 310 provided with the balance rods 311, stability of the aerobat could be effectively enhanced, resulting in more stable flight. Besides, since the parts of the two propellers are mostly connected by hinges, meaning that the propellers are adjustable propellers, not only are the propellers not susceptible to deformation when impacted, but they could also effectively prevent hurting an operator and significantly improve playing safety. Moreover, since the propellers adopt hinge connections, blades of the propellers are foldable. Accordingly, overall size of the aerobat is significantly reduced. Product packages are therefore reduced in size, transportation and carrying are also significantly more convenient, and transportation costs are saved. The above described structure has an even better effect when it is used on a large sized aerobat.

As shown in FIG. 2, the fuselage walls form a shape of an easy-open can, that is, a shape of a cylinder, enclosing a cavity and comprise a top cover 501, a bottom cover 502, a front wall 504 and a rear wall 505; a center opening is provided on top of the top cover 501; a center opening, a signal receiving opening and a port installation opening are provided on top of the bottom cover 502; blocking pins and blocking pin holders are provided at the front wall 504 and the rear wall 505 respectively for convenient assembly and fixation; when the front wall 504 and the rear wall 505 are snap-fitted, their top ends are covered by the front cover 501 and their lower ends are fitted with the bottom cover 502, and transparent adhesives are applied to lines of connection for tightening. The fuselage could also adopt a bottle shape, a cubic shape, a prismatic shape, a regular shape or an irregular shape; and all these shapes of the fuselage are intended to be shapes of an aerobat without a tail. A system consisting of upper and lower propellers produces symmetrical balance, and therefore is more suitable for these shapes and of course suitable for existing aerobat shapes.

The transmission system 53 comprises the transmission axes 520, the transmission gears 530, the power source 540 and the mechanical frame 550, wherein the transmission axes 520 comprise a first transmission shaft 521 and a second transmission shaft 522; the first transmission shaft 521 and the second transmission shaft 522 are two shafts with an identical central axis; the first transmission shaft 521 adopts a stepped shaft structure with its upper end connected to the first propeller 310 and its lower end fixedly connected to the mechanical frame 550; An upper end of the second transmission shaft 552 is fixedly connected to the mechanical frame 550 and a lower end of the second transmission shaft 552 is connected to the second propeller 320 and a shaft base 5223; the transmission gears 530 comprises a first transmission gear 531 and a second transmission gear 532; the first transmission gear 531 is evenly distributed with small holes on its spoke; the second transmission gear 532 is also evenly distributed with small holes on its spoke; the purpose of opening small holes on the spokes is to reduce weight of the gears; the power source 540 comprises a first motor 541 and a second motor 542; the first motor 541 is fixedly provided with a motor shaft gear 5411 on its power output shaft; the second motor 542 is fixed provided with a motor shaft gear 5421 on its power output shaft; the mechanical frame 550 comprises an upper frame arm 551 and a lower frame arm 552; the upper frame arm 551 is provided with a shaft sleeve at an upper part of its central portion; a lower end of the first transmission shaft 521 passes through the shaft sleeve and then fixedly connected to the first transmission gear 531; the lower frame arm 552 is provided with another shaft sleeve at a lower part of its central portion; an upper end of the second transmission shaft 522 passes through the shaft sleeve and then fixedly connected to the second transmission gear 532; the first transmission gear 531 and the second transmission gear 532 is fixed in position between the upper frame arm 551 and the lower frame arm 552; the upper frame arm 551 is provided with openings 5513 at its periphery; the lower frame arm 552 is provided with screw seats 5521 vertically extended upward at its periphery; the upper frame arm 551 and the lower frame arm 552 is fixedly connected by screws and bolts via the openings 5513 and the screw seats 5521; one end of the lower frame arm 552 is provided with two position fixing openings 5523; the two position fixing openings 5523 are symmetrically distributed on a rotary tangent line of the lower frame arm 552 along radial direction of the lower frame arm 552; the first motor 541 and the second motor 542 is fixedly fitted in the two position fixing openings 5523; the motor shaft gear 5411 of the first motor 541 is engaged with the first transmission gear 531; the motor shaft gear 5421 of the second motor 542 is engaged with the second transmission gear. Use of two transmission shafts with an identical central axis prevents a single motor from causing mechanical frictions and power energy wastage due to frequent direction changing operations when changing control status, and eliminates tail fins that assist in direction changing so that the fuselage has a more simple structure. Use of two shafts with independent transmission control facilitates more flexible and stable cooperation between the propellers, reduces users' operation difficulties and results in smoother and brisker control.

The controller is provided on the bottom cover 502; the power supply 59 is fixedly provided at a suitable position inside the fuselage 50; the power supply 59 is connected to the controller 57 to provide power for the controller 57; the controller 57 receives control signals from a remote control via the signal receiving opening on the bottom cover 502, and then controls the first motor 541 and the second motor 542 to operate respectively, wherein power is transmitted to the first transmission shaft 521 via engagement and rotation of the motor shaft gear 5411 of the first motor 541 and the first transmission gear 531 whereupon the first transmission shaft 521 actuates the first propeller 310 to rotate, or, power is transmitted to the second transmission shaft 522 via engagement and rotation of the motor shaft gear 5421 of the second motor 542 and the second transmission gear 532 whereupon the second transmission shaft 522 actuates the second propeller 320 to rotate; independent control of the two propellers is therefore achieved; by controlling electricity provided to the two propellers, rotation speed of the two propellers is being controlled also.

As shown in FIG. 2, the undercarriage 70 is mounted at a bottom part of the fuselage 50 between the second propeller 320 and the shaft base 5223 of the second transmission shaft 522; the undercarriage 70 is a tripod; a reinforcement rib 703 and an undercarriage sleeve 705 are provided on the undercarriage 70; the reinforcement rib 703 has a ring shape and divided into three arcs connected respectively to legs of the undercarriage; the undercarriage sleeve 705 is provided at an upper central part of the tripod of the undercarriage; the second transmission shaft 522 is mounted with a clearance fitted on the undercarriage sleeve 705.

When the aerobat has to turn left, it will turn left when action force generated by controlling of the first propeller 310 by the controller 57 is greater than the action force of the second propeller 320. Likewise, when the aerobat has to turn right, it will turn right when action force generated by controlling of the first propeller 310 by the controller 57 is less than the action force of the second propeller 320.

When reaction force generated by rotation of the second propeller 320 and the action force generated by the first propeller offset with each other, the fuselage 50 of the aerobat will maintain a stationary hover.

Suspension in air occurs when elevation force generated by the upper and the lower propellers obtains an equivalent steady value, and its occurrence is related to operation skills of an operator.

The present invention could also be driven by a single motor according to the following first embodiment: the second propeller is driven by the single motor, wherein the second propeller is a dynamic propeller to elevate the aerobat, and the first propeller is passively rotated in a reversed direction by influence of air current.

In a second embodiment: the first and second propellers are driven by the single motor simultaneously, wherein the first and the second propellers rotate in mutually opposite directions.

In another embodiment, a propeller adopts a cross shape. According to experiments, a double layer propeller in propeller structure of a cross shape with balancing function obtained by changing propeller shape and surface area improves flying of cylindrical aerobat. However, this embodiment involves relatively complicated skills, poor stability and bulky fuselage. Yet this embodiment has a characteristic design which enhances flying performance and reduces energy consumption. Therefore, propellers with a structure according to this embodiment are suitable for smaller sized aerobat.

In another embodiment, a propeller may also adopt an inverted Y shape and may likewise attain the same or similar functions and effects.

A person skilled in the art of this technical field may change or amend the above description based on the disclosure and teaching of the above specification. Therefore, the present invention is not limited to the detailed description disclosed and described above. Some changes or amendments should also fall within the scope of protection of the Claims of the present invention. Also, the above specification has used some certain specific jargons, but those jargons are only intended for more convenient explanation and should not constitute any limitation to the present invention.

What is claimed is:

1. An aerobat toy comprising propellers, a fuselage and an undercarriage, wherein the propellers comprise a first propeller and a second propeller; the first propeller is provided at a top part of the fuselage, and the second propeller is provided between the fuselage and the undercarriage thereunder; two transmission axes of the first and the second propellers have separated structure; the two transmission axes of the first and the second propellers are on one and identical vertical line; the two transmission axes of the first and the second propellers are each driven by an independent transmission mechanism, and the two transmission axes rotate in mutually reversed directions; the fuselage adopts a cylindrical shape, a bottle shape, a cubic shape or a prismatic shape; the aerobat toy comprises two motors; the first propeller is driven by a first motor of the two motors and the second propeller is driven by a second motor of the two motors, and the first propeller and the second propeller rotate in mutually reversed directions; the first propeller comprises a connection block, blades and balance rods; the connection block, the blades and the balance rods are connected by hinges; the second propeller comprises a connection block and blades and the blades are mounted at ends of the connection block respectively; the balance rods comprise balance main rods and balance blocks; the balance blocks are provided at ends of the balance main rods respectively: the balance rods and the connection block of the first propeller are connected by hinges; the first propeller is capable of being controlled by a controller to generate an action force different from an action force of the second propeller to change a flying direction of the aerobat toy; the balance rods are parallel in structure and also comprises a connector; hinge configurations are provided respectively at two diagonal points of the connector and a middle point of a diagonal line thereof; the connector is hinged with the balance rods at its said diagonal points.

2. The aerobat toy as in claim 1, wherein the first propeller and the second propeller are single-piece propellers or have blades arranged in across shape.

* * * * *